US010933459B2

(12) United States Patent
Takahashi et al.

(10) Patent No.: US 10,933,459 B2
(45) Date of Patent: Mar. 2, 2021

(54) JOINING APPARATUS AND MANUFACTURING METHOD FOR JOINT

(71) Applicant: TOYOTA JIDOSHA KABUSHIKI KAISHA, Toyota (JP)

(72) Inventors: Kohei Takahashi, Nisshin (JP); Atsushi Kawakita, Miyoshi (JP); Junichiro Makino, Nagakute (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/357,444

(22) Filed: Mar. 19, 2019

(65) Prior Publication Data

US 2019/0291164 A1 Sep. 26, 2019

(30) Foreign Application Priority Data

Mar. 26, 2018 (JP) ..... JP2018-058514

(51) Int. Cl.
*B21D 39/00* (2006.01)
*B21D 39/03* (2006.01)
*B23P 19/02* (2006.01)

(52) U.S. Cl.
CPC ..... *B21D 39/031* (2013.01)

(58) Field of Classification Search
CPC ..... B23P 19/02; B21D 39/031; B21D 39/00; B21D 39/03
See application file for complete search history.

(56) References Cited

U.S. PATENT DOCUMENTS

| | | | | |
|---|---|---|---|---|
| 9,283,612 | B2 * | 3/2016 | Trojer | B21D 39/031 |
| 2004/0168297 | A1 * | 9/2004 | Nishimura | B21J 15/025 29/521 |
| 2010/0018278 | A1 * | 1/2010 | Trojer | B21D 39/031 72/352 |
| 2010/0083480 | A1 * | 4/2010 | Carter | B21D 39/032 29/432 |
| 2012/0279271 | A1 * | 11/2012 | Carter | H05B 6/101 72/342.8 |

FOREIGN PATENT DOCUMENTS

| | | | | |
|---|---|---|---|---|
| CN | 203578591 | U | 5/2014 | |
| EP | 3431217 | A1 | 1/2019 | |
| EP | 3431217 | A4 * | 11/2019 | B23K 20/123 |
| JP | 2009-226414 | A | 10/2009 | |
| JP | 2017-164788 | A | 9/2017 | |

* cited by examiner

*Primary Examiner* — Bayan Salone
(74) *Attorney, Agent, or Firm* — Sughrue Mion, PLLC

(57) ABSTRACT

A joining apparatus includes: a die having a recess; and a punch disposed opposite to the recess. The punch includes an inner punch portion and an outer punch portion disposed around the inner punch portion, the inner punch portion and outer punch portion are configured to be movable relative to each other, and a depression is formable at a front end of the punch. The joining apparatus is configured such that, in a state in which the depression is formed at the front end of the punch, the punch is moved relatively so as to press and deform the multiple plate members toward the recess by the punch, and the inner punch portion is moved relatively so as to extrude a metal in the depression by the inner punch portion.

10 Claims, 5 Drawing Sheets

JOINING APPARATUS AND MANUFACTURING METHOD FOR JOINT

INCORPORATION BY REFERENCE

The disclosure of Japanese Patent Application No. 2018-058514 filed on Mar. 26, 2018 including the specification, drawings and abstract is incorporated herein by reference in its entirety.

BACKGROUND

1. Technical Field

The present disclosure relates to a joining apparatus and a manufacturing method for a joint.

2. Description of Related Art

Conventionally, there has been known a joining apparatus that joins multiple metallic plate members by mechanical clinching (e.g. see Japanese Patent Application Publication No. 2009-226414).

The joining apparatus of the related art is configured to include a die having a recess and a punch disposed opposite to the recess in such a manner that the punch is movable relative to the die. Then, in a state in which a flat lower plate (plate member disposed on the die side) and a flat upper plate (plate member disposed on the punch side) are placed on the die, the punch is moved toward the die so as to press and deform the upper plate and the lower plate toward the recess by the punch, to thereby form an interlock portion. With this interlock portion, the upper plate and the lower plate are mechanically joined to each other.

SUMMARY

Here, in the joining apparatus of the relater art, when the strength of the upper plate is lower than the strength of the lower plate, it is conceivable that formation of the interlock portion becomes difficult. Specifically, in the case in which the strength of the upper plate is lower than the strength of the lower plate, when the upper plate and the lower plate are pressed toward the recess by the punch, a metal (upper plate base material) configuring the upper plate between the lower plate and the punch flows circumferentially outward of the punch, and the upper plate base material between the punch and the lower plate comes in short supply, which might hinder formation of the interlock portion.

The present disclosure provides a joining apparatus capable of forming an interlock portion even when the strength of a plate member disposed on the punch side is lower than the strength of a plate member disposed on the die side, and also provides a manufacturing method for a joint using the joining apparatus.

A joining apparatus according to the first aspect of the present disclosure is a joining apparatus that joins multiple plate members made of a metal by mechanical clinching, and includes: a die having a recess; and a punch disposed opposite to the recess. The punch is configured to include an inner punch portion and an outer punch portion disposed around the inner punch portion such that the inner punch portion and outer punch portion are movable relative to each other, and to form a depression at a front end of the punch. The joining apparatus is configured such that, in a state in which the depression is formed at the front end of the punch, the die and the punch are moved relative to each other so as to press and deform the multiple plate members toward the recess by the punch, and the inner punch portion and the outer punch portion are moved relative to each other so as to extrude the metal in the depression by the inner punch portion.

With this configuration, it is possible to secure the metal (base material) configuring the plate member in the depression formed at the front end of the punch; therefore, the interlock portion can be formed by extrusion of this metal.

In the above joining apparatus, the multiple plate members may be two plate members that includes a first plate member and a second plate member, and the first plate member disposed on the punch side may have a lower strength than a strength of the second plate member disposed on the die side.

With this configuration, it is possible to form the interlock portion when the strength of the plate member disposed on the punch side is lower than the strength of the plate member disposed on the die side.

In the above joining apparatus, the depression may be formed by relatively moving the outer punch portion toward the plate members such that the outer punch portion is closer to the plate members than the inner punch portion is.

In the above joining apparatus, the inner punch portion may have a columnar shape, and the outer punch portion may have a cylindrical shape.

In the above joining apparatus, a bottom surface of the die partially defining the recess may have an annular groove around a peripheral edge of the bottom surface.

A manufacturing method for a joint according to the second aspect of the present disclosure is a manufacturing method that manufactures the joint formed by joining multiple plate members made of a metal by mechanical clinching, using a joining apparatus including a die having a recess, and a punch disposed opposite to the recess. The punch is configured to include an inner punch portion and an outer punch portion disposed around the inner punch portion such that the inner punch portion and outer punch portion are movable relative to each other, and to form a depression at a front end of the punch. The method for the joint includes: moving the die and the punch relative to each other, in a state in which the depression is formed at the front end of the punch, so as to press and deform the multiple plate members toward the recess by the punch; and moving the inner punch portion and the outer punch portion relative to each other so as to extrude the metal in the depression by the inner punch portion.

With this configuration, it is possible to secure the metal (base material) configuring the plate member in the depression formed at the front end of the punch; therefore, the interlock portion can be formed by extrusion of this metal.

In the above manufacturing method for the joint, the multiple plate members may be two plate members that includes a first plate member and a second plate member, and the first plate member disposed on the punch side may have a lower strength than a strength of the second plate member disposed on the die side.

With this configuration, it is possible to form the interlock portion when the strength of the plate member disposed on the punch side is lower than the strength of the plate member disposed on the die side.

In the above manufacturing method for the joint, the depression may be formed by relatively moving the outer punch portion toward the plate members such that the outer punch portion is closer to the plate members than the inner punch portion is.

In the manufacturing method for the joint, the inner punch portion may have a columnar shape, and the outer punch portion may have a cylindrical shape.

In the above manufacturing method for the joint, a bottom surface of the die partially defining the recess may have an annular groove around a peripheral edge of the bottom surface.

According to the joining apparatus and the manufacturing method for a joint using the joining apparatus, it is possible to form the interlock portion even when the strength of the plate member located on the punch side is lower than the strength of the plate member located on the die side.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

Hereinafter, one embodiment of the present disclosure will be described based on the drawings.

Figure 2:
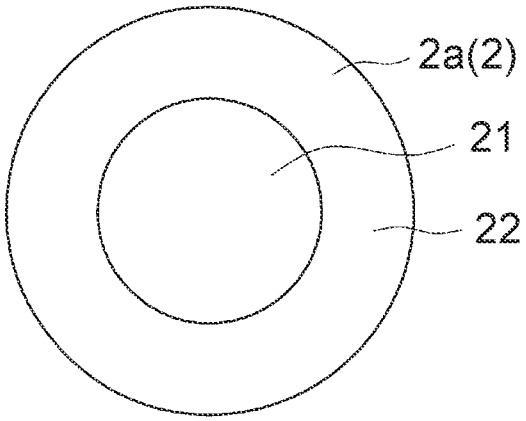
FIG. 2 is a view showing a front end of a punch of the joining apparatus of FIG. 1.
Figure 3:
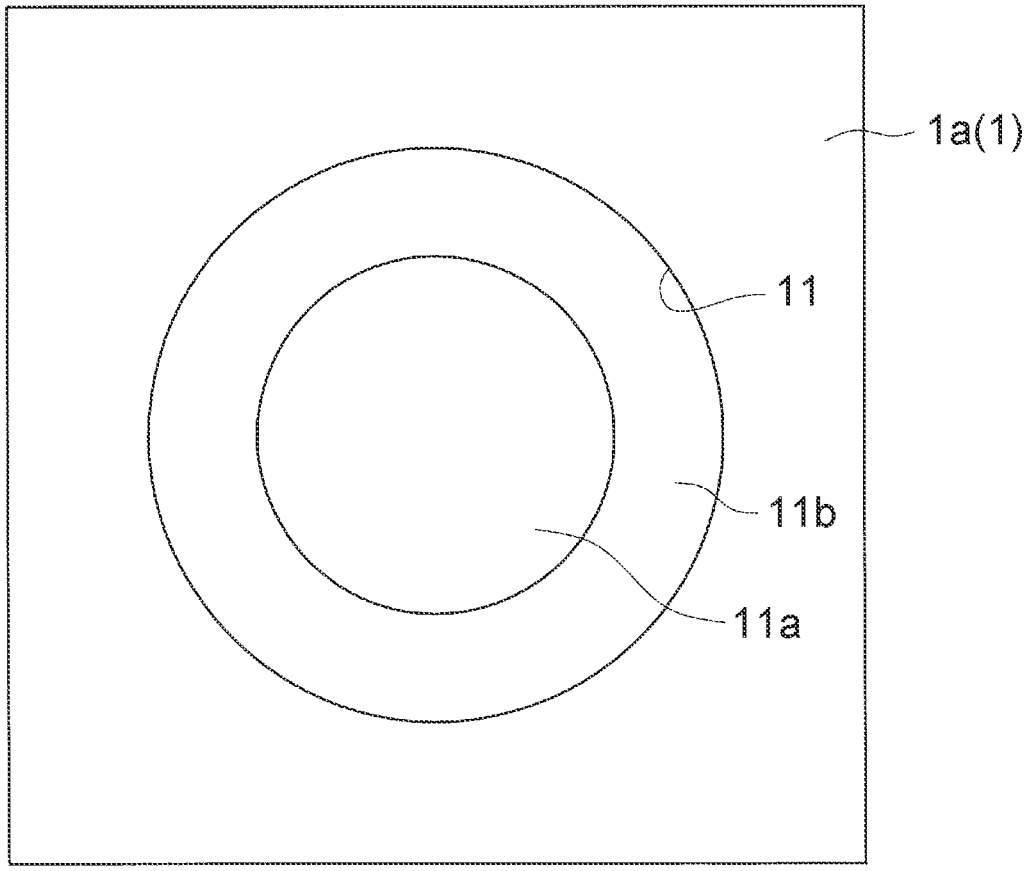
FIG. 3 is a plan view showing a recess of a die of the joining apparatus of FIG. 1.

First, with reference to FIG. 1 to FIG. 3, a joining apparatus 100 according to one embodiment of the present disclosure will be described.

The joining apparatus 100 is configured to join two metallic plate members 60, 70 by mechanical clinching. As shown in FIG. 1, this joining apparatus 100 is configured to include a die 1 and a punch 2 such that the punch 2 is movable relative to the die 1.

The die 1 has a front surface 1*a* on which the plate members 60, 70 can be placed. The front surface 1*a* is formed with a recess 11. The recess 11 (see FIG. 3) is formed in a circular shape in plan view (as viewed from a direction Z1). A depth of this recess 11 is set depending on the thicknesses of the plate members 60, 70, for example. An annular groove 11*b* (see FIG. 3) is formed around a peripheral edge of a bottom surface 11*a* of the recess 11.

The plate members 60, 70 are stacked on the front surface 1*a* of the die 1. Specifically, the plate member 60 is placed on the front surface 1*a* of the die 1, and the plate member 70 is placed on the plate member 60. The material of the plate member 60 is a high tensile steel, for example, and the material of the plate member 70 is an aluminum alloy, for example. Hence, the plate member 70 has a strength (tensile strength) lower than a strength of the plate member 60. That is, the plate member 70 has a higher malleability than that of the plate member 60, and when pressure is applied, the plate member 70 is more deformable than the plate member 60 is. Note that the plate member 60 is one example of a second plate member of the present disclosure and the plate member 70 is one example of a first plate member of the present disclosure.

The punch 2 is disposed opposite to the recess 11 of the die 1, and is configured to be movable in a height direction (directions Z1 and Z2) relative to the die 1. The punch 2 (see FIG. 2) is formed in a circular shape as viewed from the front end 2*a* side (as viewed from the direction Z2). The central axis of the punch 2 coincides with the center of the recess 11, and the punch 2 has a smaller diameter than a diameter of the recess 11. This punch 2 includes an inner punch portion 21 disposed at the center, and an outer punch portion 22 disposed around the inner punch portion 21.

The inner punch portion 21 is formed in a columnar shape, the outer punch portion 22 is formed in a cylindrical shape, and the inner punch portion 21 is fitted into the inside of the outer punch portion 22. The inner punch portion 21 and the outer punch portion 22 are configured to be movable relative to each other, and a depression 23 (see FIG. 4) can be formed at the front end 2*a*.

The joining apparatus 100 is configured such that the punch 2 with the depression 23 formed at the front end 2*a* thereof is moved downward (in the direction Z1) relative to the die 1 on which the plate members 60, 70 are placed, to thereby press and deform the plate members 60, 70 toward the recess 11 by the punch 2; and thereafter a metal 71 (see FIG. 5) in the depression 23 is extruded by the inner punch portion 21.

Manufacturing Method for Joint

Next, with reference to FIG. 1 and FIG. 4 to FIG. 8, the manufacturing method for the joint 50 using the joining apparatus 100 of the present embodiment (an example of operation of the joining apparatus 100) will be described.

Figure 1:
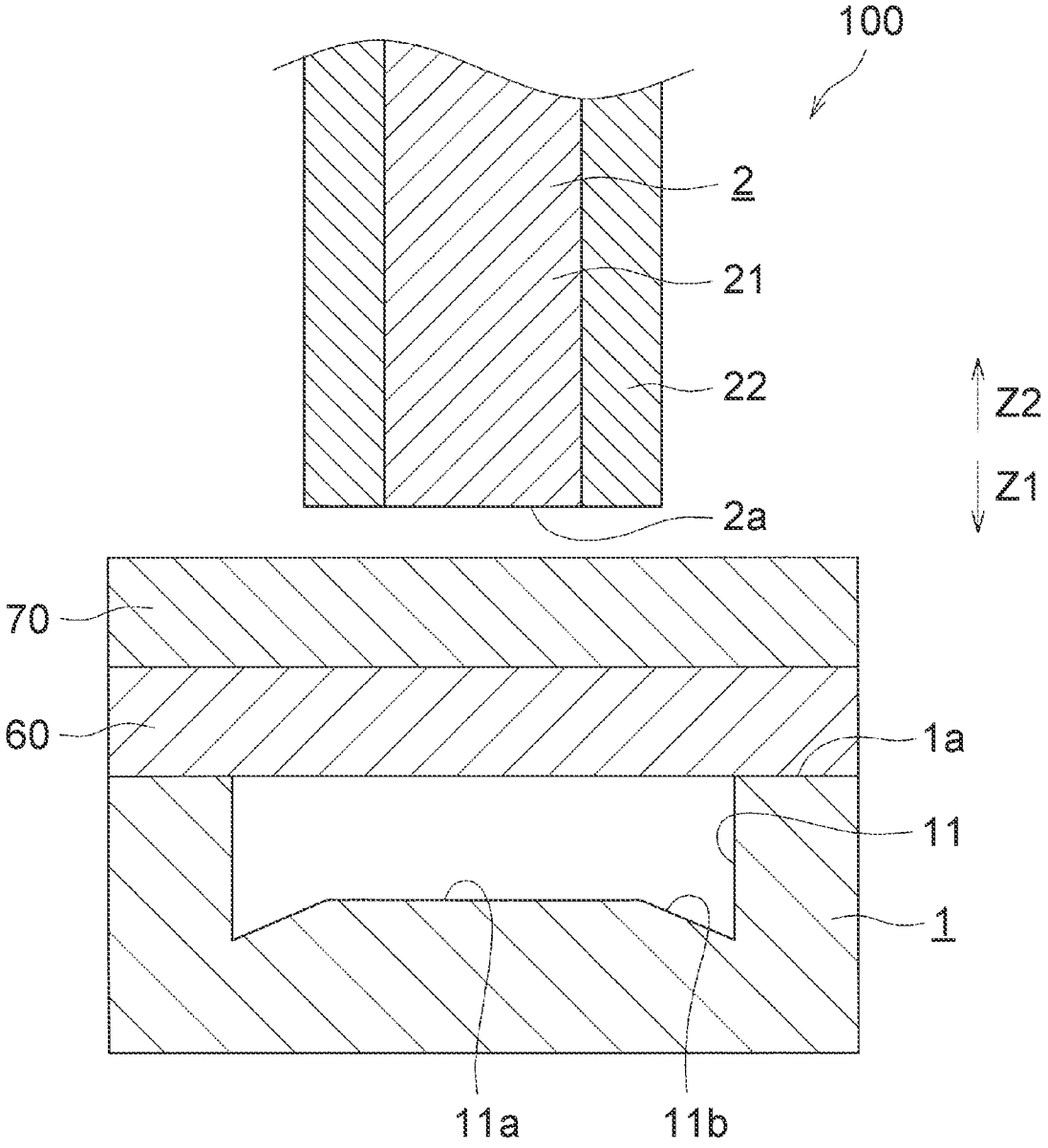
FIG. 1 is a schematic sectional view explaining a joining apparatus according to the present embodiment.

First, as shown in FIG. 1, the plate member 60 is placed on the front surface 1*a* of the die 1, and the plate member 70 is placed on the plate member 60. The plate member 70 disposed on the punch 2 side has a lower strength than that of the plate member 60 disposed on the die 1 side. The plate members 60, 70 are pushed against the front surface 1*a* of the die 1 by a stripper (not illustrated).

Figure 4:
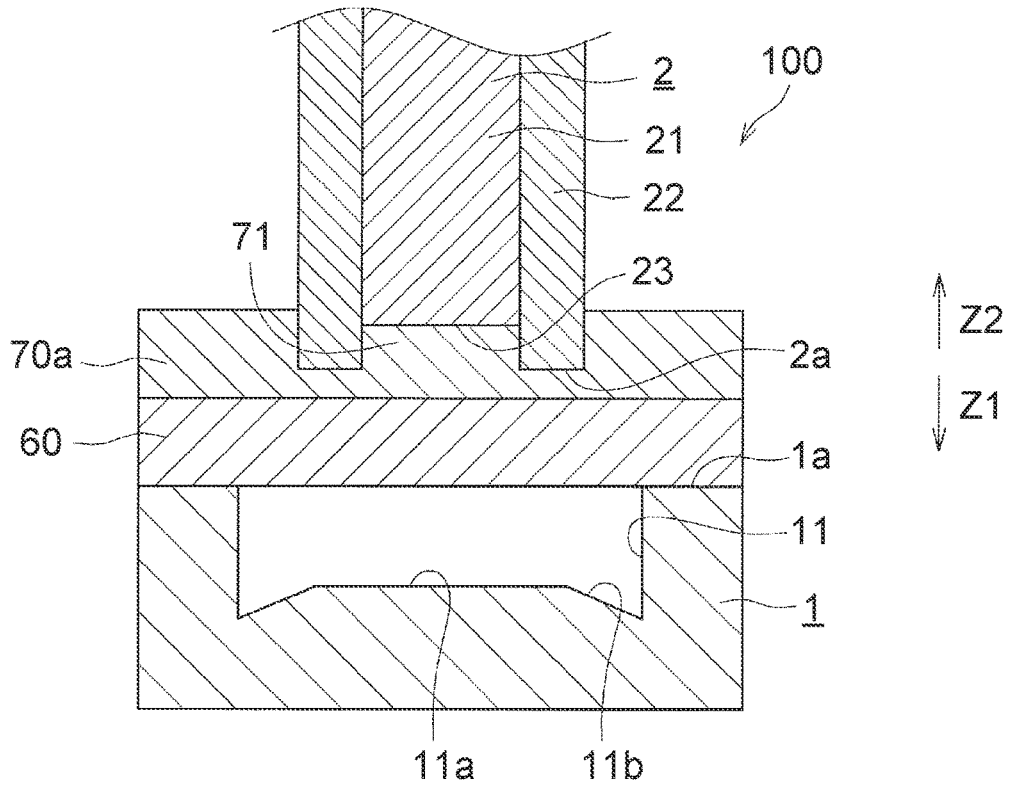
FIG. 4 is a view explaining a manufacturing method for a joint using the joining apparatus according to the present embodiment, and is a schematic sectional view showing a state in which a depression is formed at the front end of the punch.

Then, as shown in FIG. 4, the outer punch portion 22 is moved downward (in the direction Z1) so as to form the depression 23 at the front end 2*a* of the punch 2. Then, both of the inner punch portion 21 and the outer punch portion 22 are moved downward. Hence, the outer punch portion 22 comes into contact with and enters into a plate member 70*a* before the inner punch portion 21 does. The depression 23 of the punch 2 is filled with the metal (upper plate base material) 71 configuring the plate member 70*a*. This metal 71 is used when an interlock portion 74 (see FIG. 6) described later is formed. That is, the depression 23 of the punch 2 is provided for securing the metal 71 to be used for forming the interlock portion 74.

Figure 5:
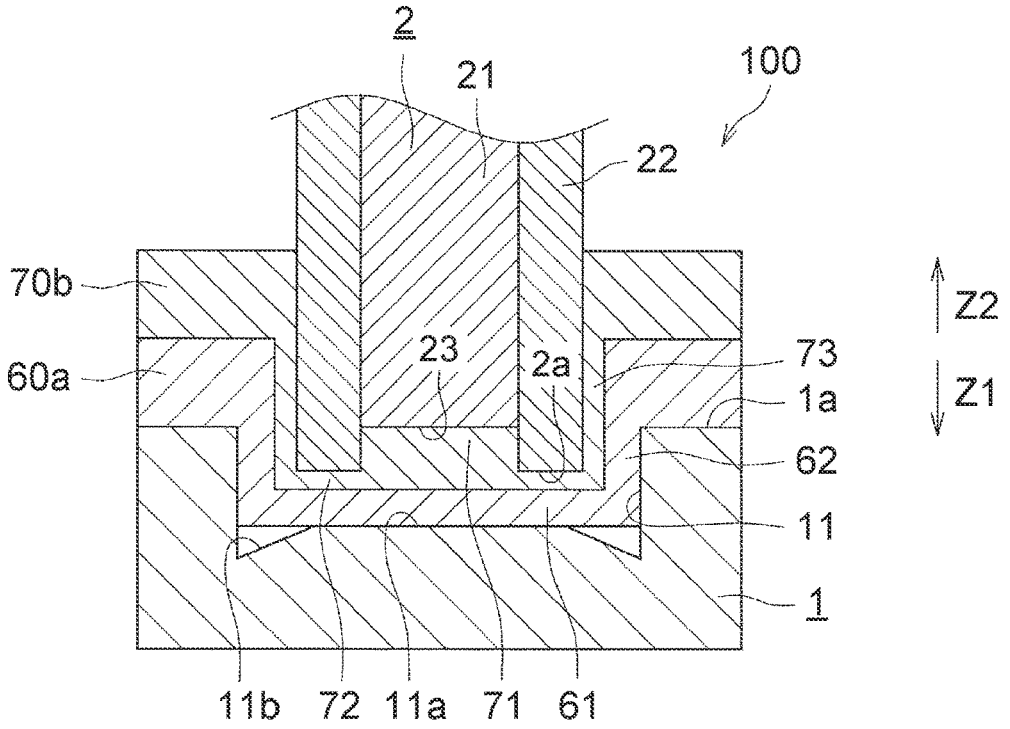
FIG. 5 is a view explaining the manufacturing method for the joint using the joining apparatus according to the present embodiment, and is a schematic sectional view showing a state in which the front end of the punch enters in the recess of the die.

Both of the inner punch portion 21 and the outer punch portion 22 are further moved downward, and the plate members 70*a*, 60 are thus pressed by the punch 2, and thereby the plate members 70*a*, 60 are deformed and the front end 2*a* of the punch 2 is pushed into the recess 11, as shown in FIG. 5. At this time, a plate member 60*a* is formed with a bottom portion 61 in contact with the bottom surface 11*a* of the recess 11, and also with a lateral circumferential portion 62 in contact with the inner circumferential surface of the recess 11. In addition, a plate member 70*b* is formed with a bottom portion 72 between the bottom portion 61 of the plate member 60*a* and the front end 2*a* of the punch 2, and also with a lateral circumferential portion 73 between the lateral circumferential portion 62 of the plate member 60*a* and the outer circumferential surface of the outer punch portion 22. The depression 23 is filled with the metal 71, so that the bottom portion 72 has a thicker thickness in a region corresponding to the inner punch portion 21 than a thickness in a region corresponding to the outer punch portion 22. How much the punch 2 should enter into the recess 11 is set depending on the depth of the recess 11 or the like, for example.

Figure 6:
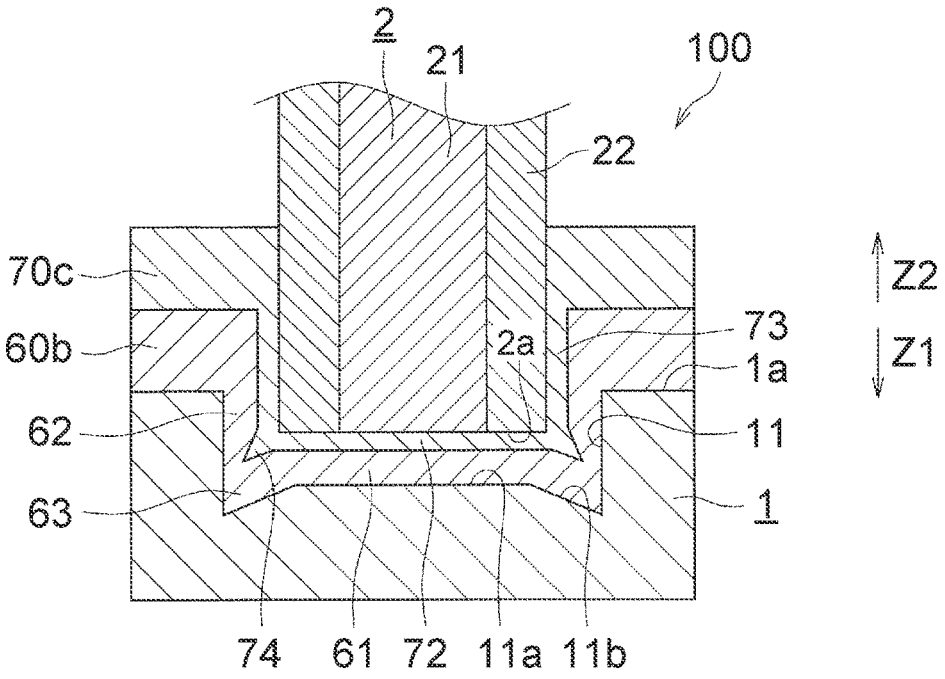
FIG. 6 is a view explaining the manufacturing method for the joint using the joining apparatus according to the present embodiment, and is a schematic sectional view showing a state in which metal in the depression is extruded by an inner punch portion.

Subsequently, the inner punch portion 21 is moved downward so as to cancel the depression 23 of the punch 2 as shown in FIG. 6, and thus the front end 2*a* of the punch 2 is flattened. Accordingly, the metal 71 (see FIG. 5) in the depression 23 is extruded, and due to pressure resulting from this extrusion, a plate member 60*b* is formed with an annular projection 63, and a plate member 70*c* is formed with the interlock portion 74 at the same time. The annular projection 63 is formed as the metal configuring the plate member 60*a* (see FIG. 5) is released into the groove 11*b*, and thus the interlock portion 74 is formed together with the annular projection 63. The interlock portion 74 is formed to outwardly expand in the radial direction from the lateral circumferential portion 73 in such a manner that the interlock portion 74 enters the lateral circumferential portion 62 of the plate member 60*b*. Accordingly, the interlock portion 74 is engaged with the lateral circumferential portion 62, to thereby mechanically join the plate member 60*b* and the plate member 70*c* to each other.

Figure 7:
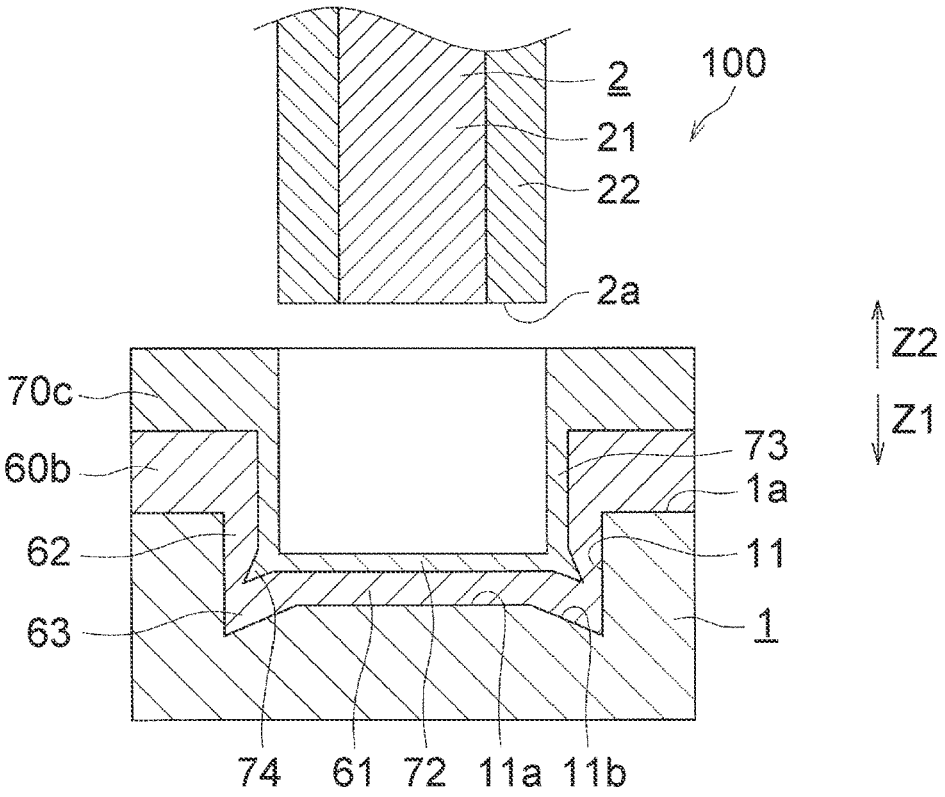
FIG. 7 is a view explaining the manufacturing method for the joint using the joining apparatus according to the present embodiment, and is a schematic sectional view showing a state in which the punch is removed.

Thereafter, the punch 2 is moved upward (in the direction Z2) so as to be removed from the plate members 60*b*, 70*c*, as shown in FIG. 7. Subsequently, the pressing by the striper is released, and the plate members 60*b*, 70*c* are then removed from the die 1.

Figure 8:
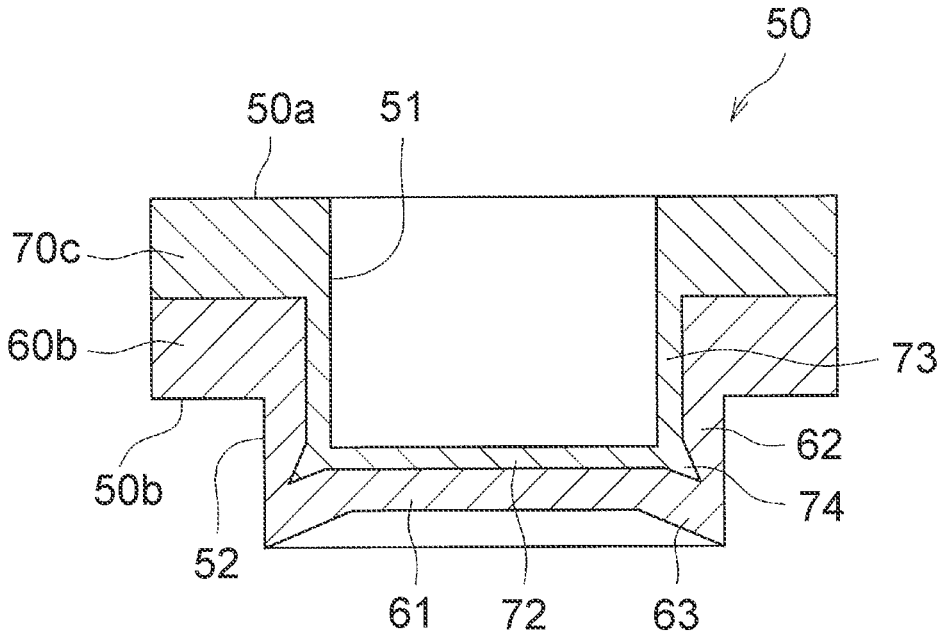
FIG. 8 is a schematic sectional view showing a joint joined by the joining apparatus of the present embodiment.

In this manner, the joint 50 as shown in FIG. 8 is manufactured. In this joint 50, the plate members 60*b*, 70*c* are mechanically joined by the annular interlock portion 74. That is, the flat plate members 60, 70 in a stacked state are deformed (plastically deformed) by the die 1 and the punch 2, to be formed into the plate members 60*b*, 70*c*. These plate members 60*b*, 70*c* are joined by the interlock portion 74 into the joint 50. A recess 51 is formed in one surface (surface on the punch 2 side) 50*a* of the joint 50, and a projection 52 is formed on the other surface (surface on the die 1 side) 50*b* of the joint 50.

Advantageous Effects

As described above, in the present embodiment, it is configured that, in the state in which the depression 23 is formed at the front end 2*a* of the punch 2, the punch 2 is moved downward so as to press and deform the plate members 60, 70 toward the recess 11 by the punch 2, and thereafter the metal 71 in the depression 23 is then extruded by the inner punch portion 21. With this configuration, since the metal (upper plate base material) 71 configuring the plate member 70*b* can be secured in the depression 23 of the front end 2*a* of the punch 2, the interlock portion 74 can be formed by extruding the metal 71. Therefore, even when the strength of the plate member 70 disposed on the punch 2 side is lower than the strength of the plate member 60 disposed on the die 1 side, the interlock portion 74 can be formed; accordingly, the joint 50 can be manufactured.

Another Embodiment

The above-disclosed embodiment is to all intents and purposes merely illustrative and should not be construed as limiting. Thus, the technical scope of the present disclosure is defined by the claims and is not in any way restricted by only the descriptions of the above-described embodiments. Furthermore, all variations within the meaning and range of equivalency of the claims fall within the technical scope of the present disclosure.

For example, in the above embodiment, although the joining apparatus 100 has been exemplified by the configuration of joining the two plate members 60, 70 to each other by mechanical clinching, the present disclosure is not limited to this. The joining apparatus may be configured to join three or more plate members to each other by mechanical clinching.

In the above-described embodiment, although it has been exemplified that the strength of the plate member 70 is lower than the strength of the plate member 60, the present disclosure is not limited to this. Both of the plate members may have the same strength. That is, although it has been exemplified that the material of the plate member 70 is an aluminum alloy, and the material of the plate member 60 is a high tensile steel, the present disclosure is not limited to this. The materials of both of the plate members may be the same (e.g. an aluminum alloy).

In the above embodiment, the plate members 60, 70 may have the same thickness or different thicknesses.

In the above embodiment, although it has been exemplified that the punch 2 is moved relative to the die 1, the present disclosure is not limited to this. The die may be moved relative to the punch. For example, it may be configured that the die is moved relative to the punch formed with the depression in such a manner that the front end of the punch enters into the recess of the die, and thereafter the outer punch portion is moved together with the die so as to extrude the metal present in the depression.

In the above embodiment, although it has been exemplified that the punch 2 and the recess 11 are each formed in a circular shape, the present disclosure is not limited to this. The punch and the recess may be formed in another shape, such as a polygonal shape.

In the above embodiment, although it has been exemplified that the groove 11*b* is formed in the recess 11, the present disclosure is not limited to this. No groove is not formed in the recess.

The present disclosure is useable for a joining apparatus that joins multiple metallic plate members by mechanical clinching, and for a manufacturing method for a joint using the joining apparatus.

What is claimed is:

1. A joining apparatus joining multiple plate members made of a metal by mechanical clinching, the joining apparatus comprising:

a die having a recess; and a punch disposed opposite to the recess, wherein the punch includes an inner punch portion and an outer punch portion disposed around the inner punch portion, the inner punch portion and the outer punch portion are configured to move relative to each other and are configured to enter into the recess, and in a state in which a depression is formed at a front end of the punch, the die and the punch are moved relative to each other so as to press and deform the multiple plate members toward the recess by the punch, and the inner punch portion and the outer punch portion are moved relative to each other so as to extrude the metal in the depression by the inner punch portion.

2. The joining apparatus according to claim 1, wherein:

the multiple plate members are two plate members that includes; a first plate member and a second plate member; and the first plate member disposed on a punch side has a lower strength than a strength of the second plate member disposed on a die side.

3. The joining apparatus according to claim 1, wherein the depression is defined by the inner punch portion and the outer punch portion when a front end of the outer punch portion is closer to the multiple plate members than is a front end of the inner punch portion.

4. The joining apparatus according to claim 1, wherein the inner punch portion has a columnar shape, and the outer punch portion has a cylindrical shape.

5. The joining apparatus according to claim 1, wherein a bottom surface of the die partially defining the recess has an annular groove around a peripheral edge of the bottom surface.

6. A manufacturing method for a joint, manufacturing the joint formed by joining multiple plate members made of a metal by mechanical clinching, the method comprising:

forming a depression at a front end of a punch including an inner punch portion and an outer punch portion disposed around the inner punch portion by moving the inner punch portion and the outer punch portion relative to each other, the inner punch portion and the outer punch portion being configured to enter into a recess of a die;

moving the die and the punch disposed opposite to the die relative to each other, in a state in which the depression is formed, so as to press and deform the multiple plate members toward the recess by the punch; and moving the inner punch portion and the outer punch portion relative to each other so as to extrude the metal in the depression by the inner punch portion.

7. The manufacturing method for the joint according to claim 6, wherein:

the multiple plate members are two plate members that includes a first plate member and a second plate member; and the first plate member disposed on a punch side has a lower strength than a strength of the second plate member disposed on a die side.

8. The manufacturing method for the joint according to claim 6, wherein the depression is formed by relatively moving the outer punch portion toward the multiple plate members such that the outer punch portion is closer to the multiple plate members than is the inner punch portion.

9. The manufacturing method for the joint according to claim 6, wherein the inner punch portion is in a columnar shape, and the outer punch portion is in a cylindrical shape.

10. The manufacturing method for the joint according to claim 6, wherein a bottom surface of the die partially defining the recess has an annular groove around a peripheral edge of the bottom surface.

* * * * *